US010312591B2

(12) United States Patent
Wu et al.

(10) Patent No.: US 10,312,591 B2
(45) Date of Patent: Jun. 4, 2019

(54) WIRELESS COMMUNICATION DEVICE

(71) Applicant: PEGATRON CORPORATION, Taipei (TW)

(72) Inventors: Chien-Yi Wu, Taipei (TW); Yu-Yi Chu, Taipei (TW); Chao-Hsu Wu, Taipei (TW); Ya-Jyun Li, Taipei (TW); Shih-Keng Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 28 days.

(21) Appl. No.: 15/853,983

(22) Filed: Dec. 26, 2017

(65) Prior Publication Data

US 2018/0254557 A1 Sep. 6, 2018

(30) Foreign Application Priority Data

Mar. 2, 2017 (TW) ..... 106106781 A

(51) Int. Cl.

| | |
|---|---|
| ***H01Q 1/24*** | (2006.01) |
| ***H01Q 5/357*** | (2015.01) |
| ***H01Q 5/28*** | (2015.01) |
| ***H01Q 5/50*** | (2015.01) |
| ***H01Q 1/48*** | (2006.01) |
| ***H01Q 5/35*** | (2015.01) |
| *H01Q 7/00* | (2006.01) |
| *H01Q 9/04* | (2006.01) |

(52) U.S. Cl.

CPC ..... *H01Q 5/357* (2015.01); *H01Q 1/243* (2013.01); *H01Q 1/48* (2013.01); *H01Q 5/28* (2015.01); *H01Q 5/35* (2015.01); *H01Q 5/50* (2015.01); *H01Q 7/00* (2013.01); *H01Q 9/0421* (2013.01)

(58) Field of Classification Search

CPC .. H01Q 5/28; H01Q 5/35; H01Q 5/50; H01Q 1/243; H01Q 1/48

See application file for complete search history.

(56) References Cited

U.S. PATENT DOCUMENTS 5,828,339 A * 10/1998 Patel ..... H01Q 1/246 343/700 MS
9,620,867 B2 * 4/2017 Hamabe ..... H01Q 21/28

FOREIGN PATENT DOCUMENTS

| | | |
|---|---|---|
| TW | I401894 B1 | 7/2013 |
| TW | I521796 | 2/2016 |
| TW | I552438 | 10/2016 |

* cited by examiner

*Primary Examiner* — Dieu Hien T Duong
(74) *Attorney, Agent, or Firm* — Winston Hsu

(57) ABSTRACT

A wireless communication device includes a metallic housing, a circuit board, a metallic heat sink, and first, second and third antennas. The metallic housing includes a chamber. The circuit board is disposed in the chamber for providing a feed signal. The metallic heat sink is disposed on the circuit board and divides the chamber into first and second regions. The first antenna is disposed at the first region along a first direction. The second antenna is disposed at the second region along a second direction perpendicular to the first direction. The third antenna is disposed at the second region along the first direction and located between the metallic heat sink and the second antenna. The first, second and third antennas are coupled with the circuit board. The first, second and third antennas receive the feed signal and at least are capable of generating signals at the same frequency band.

8 Claims, 6 Drawing Sheets

WIRELESS COMMUNICATION DEVICE

CROSS REFERENCE TO RELATED APPLICATION

This application claims the priority benefit of Taiwan application serial no. 106106781, filed on Mar. 2, 2017. The entirety of the above-mentioned patent application is hereby incorporated by reference herein and made a part of this specification.

BACKGROUND OF THE INVENTION

1. Field of the Invention

The invention relates to a wireless communication device and, in particular, to a wireless communication device including multiple antennas.

2. Description of the Prior Art

In a conventional wireless communication device including multiple antennas, transmission lines are commonly used to connect a plurality of wireless communication components to the antennas to transmit electric signals therebetween. Therefore, a larger space is needed to accommodate multiple transmission lines, which is difficult for applications with compact form factors. Furthermore, the use of multiple transmission lines results in complicated wirings, larger power losses, lower heat dissipating capability and more electromagnetic interferences. To reduce the interference of the wireless signals in the same communication frequency band transmitted by adjacent antennas, conventionally co-existence and time-sharing techniques are used to share the CPU time slots among multiple wireless communication components and multiple antennas when transmitting wireless signals by multiple antennas. However, such techniques reduce the performance of the antennas transmitting wireless signals.

Therefore, for a wireless communication device including multiple antennas, how to improve the isolation between antennas and heat dissipating capability is an important issue.

SUMMARY OF THE INVENTION

The invention provides a wireless communication device, including a metallic housing, a circuit board, a metallic heat sink, a first antenna, a second antenna and a third antenna. The metallic housing includes a chamber. The circuit board is disposed in the chamber and is for providing a feed signal and a ground. The metallic heat sink is disposed on the circuit board and divides the chamber into a first region and a second region. The first antenna is disposed at the first region along a first direction. The second antenna is disposed at the second region along a second direction, wherein the second direction is perpendicular to the first direction. The third antenna is disposed at the second region along the first direction and located between the metallic heat sink and the second antenna. The first antenna, the second antenna and the third antenna are coupled with the circuit board, wherein the first antenna, the second antenna and the third antenna receive the feed signal and at least are capable of generating signals at the same frequency band.

In one embodiment of the invention, the circuit board includes a first ground point and a second ground point. The first ground point and the second ground point are located at a central region of the circuit board, and the circuit board is connected with the metallic housing via the first ground point and the second ground point.

In one embodiment of the invention, the circuit board further includes a third ground point and a fourth ground point. The third ground point and the fourth ground point are located between the first antenna and the metallic heat sink, and the circuit board is connected with the metallic housing via the third ground point and the fourth ground point.

In one embodiment of the invention, the first antenna includes a first feed terminal and a first ground terminal, the direction of the line connecting the first feed terminal and the first ground terminal is parallel to the first direction, and the first feed terminal is coupled with the circuit board to receive the feed signal. The second antenna includes a second feed terminal and a second ground terminal, the direction of the line connecting the second feed terminal and the second ground terminal is parallel to the second direction, and the second feed terminal is coupled with the circuit board to receive the feed signal. The third antenna includes a third feed terminal and a third ground terminal, the direction of the line connecting the third feed terminal and the third ground terminal is parallel to the first direction, and the third feed terminal is coupled with the circuit board to receive the feed signal.

In one embodiment of the invention, the circuit board further includes a coaxial transmission line. The coaxial transmission line includes a positive terminal and a negative terminal. The first feed terminal, the second feed terminal and the third feed terminal are electrically connected with the positive terminal of the coaxial transmission to receive the feed signal. The first ground terminal, the second ground terminal and the third ground terminal are connected with the negative terminal of the coaxial transmission line to ground.

In one embodiment of the invention, the first antenna is a quarter-wavelength planar inverted-F antenna, the second antenna is a quarter-wavelength planar inverted-F antenna, and the third antenna is a half-wavelength loop antenna.

In one embodiment of the invention, the first antenna receives the feed signal to provide a signal at a low frequency band and a signal at a high frequency band, the second antenna receives the feed signal to provide a signal at the low frequency band and a signal at the high frequency band, and the third antenna receives the feed signal to provide a signal at the low frequency band.

In one embodiment of the invention, the low frequency band provided by the first antenna is a Bluetooth frequency band at 2.4 GHz and a Wi-Fi frequency band at 2.4 GHz, and the high frequency band provided by the first antenna is a Wi-Fi frequency band at 5 GHz. The low frequency band provided by the second antenna is a Wi-Fi frequency band at 2.4 GHz, and the high frequency band provided by the second antenna is a Wi-Fi frequency band at 5 GHz. The low frequency band provided by the third antenna is a Zigbee frequency band at 2.4 GHz.

To sum up, regarding the wireless communication device including multiple antennas, the invention can improve the isolations between multiple antennas and the heat dissipating capability effectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
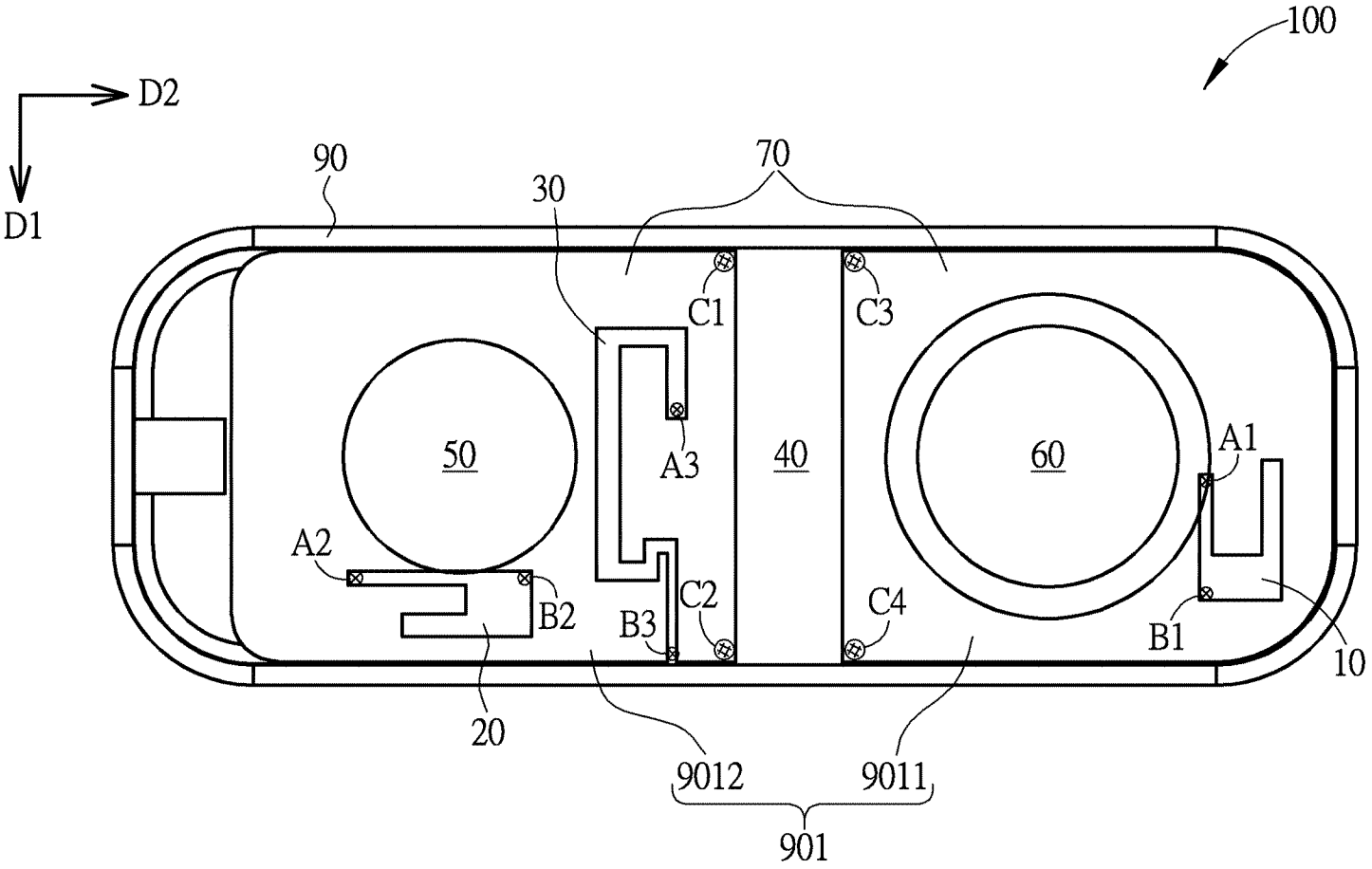
FIG. 1 is a top view of the wireless communication device according to an embodiment of the invention.
Figure 2:
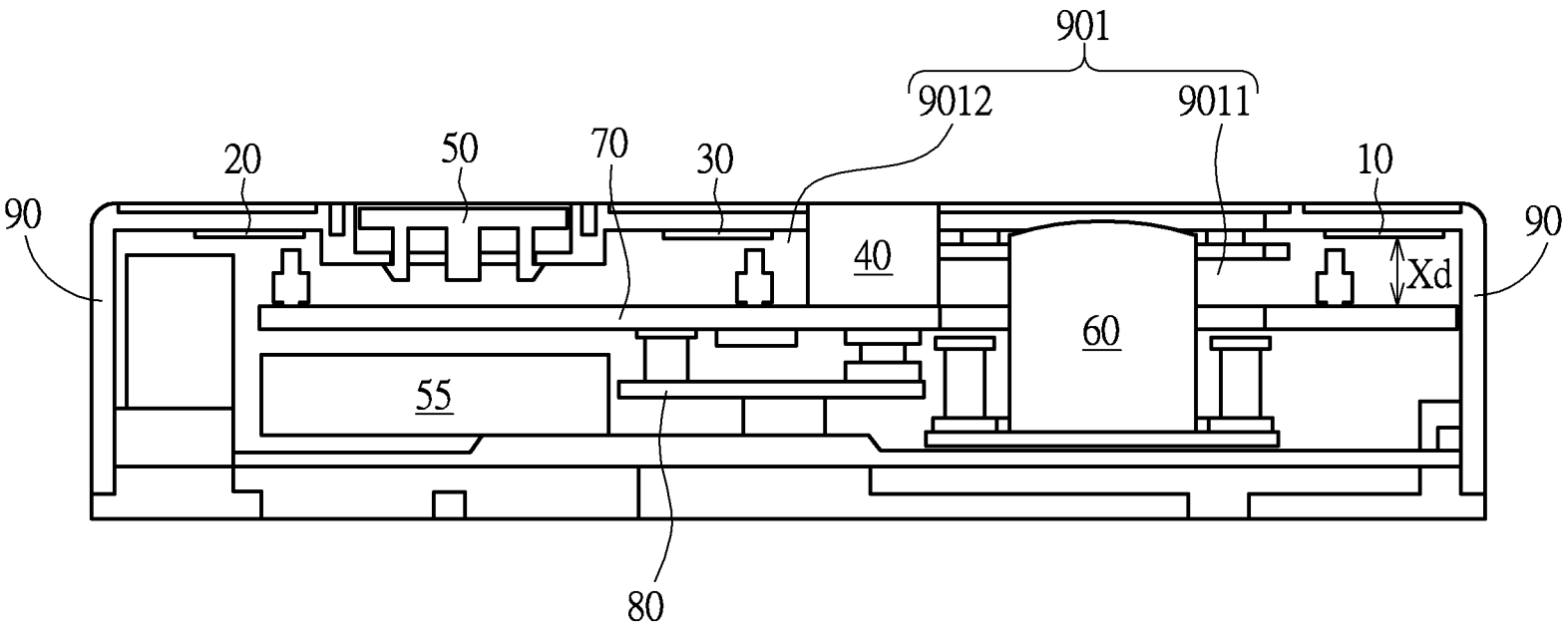
FIG. 2 is a side view of the wireless communication device according to an embodiment of the invention.

FIG. 1 is a top view of the wireless communication device 100 according to an embodiment of the invention. FIG. 2 is a side view of the wireless communication device 100 according to an embodiment of the invention. The wireless communication device 100 includes a first antenna 10, a second antenna 20, a third antenna 30, a metallic heat sink 40, a control button 50, a battery 55, a camera 60, a circuit board 70, a power adaptor board 80, and a metallic housing 90. The metallic housing 90 includes a chamber 901. The first antenna 10, the second antenna 20, the third antenna 30, the metallic heat sink 40, the control button 50, the battery 55, the camera 60, the circuit board 70, and the power adaptor board 80 are all disposed in the chamber 901.

The circuit board 70 is for providing a feed signal and a ground. The metallic heat sink 40 is disposed on the circuit board 70, and divides the chamber 901 of the metallic housing 90 into two regions. In the present embodiment, the two regions can be a first region 9011 located on the right side of the metallic housing 90 and a second region 9012 on the left side of the metallic housing 90. The first antenna 10 and the camera 60 are disposed at the first region 9011, while the second antenna 20, the third antenna 30, the control button 50, the battery 55 and the power adaptor board 80 are disposed at the second region 9012.

The wireless communication device 100 of the embodiment includes a plurality of antennas. The first antenna 10 is disposed at the first region 9011 of the metallic housing 90 along a first direction D1 and is coupled with the circuit board 70. The second antenna 20 is disposed at the second region 9012 of the metallic housing 90 along a second direction D2 and is coupled with the circuit board 70, wherein the second direction D2 is perpendicular to the first direction D1. The third antenna 30 is disposed at the second region 2012 of the metallic housing 90 along the first direction D1 between the metallic heat sink 40 and the second antenna 20, and is coupled with the circuit board 70. The first antenna 10, the second antenna 20 and the third antenna 30 receive the feed signal, and at least are capable of generating signals at the same frequency band.

The circuit board 70 includes four ground points C1 to C4, and is connected to the metallic housing 90 via the ground points C1 to C4. The ground points C1 and C2 are located at the central region of the circuit board 70, and the ground points C3 and C4 are located on the circuit board 70 between the first antenna 10 and the metallic heat sink 40, wherein the central region is located in the middle of the long side of the circuit board 70.

The first antenna 10 includes a first feed terminal A1 and a first ground terminal B1. The direction of the line connecting the first feed terminal A1 and the first ground terminal B1 is parallel to the first direction D1, and the first feed terminal A1 is coupled with the circuit board 70 to receive the feed signal. The first antenna 10 receives the feed signal to provide a signal within a low frequency band and a signal within a high frequency band. In the present embodiment, the low frequency band provided by the first antenna 10 is a Bluetooth frequency band of 2.4 GHz and a Wi-Fi frequency band of 2.4 GHz, while the high frequency band provided by the first antenna 10 is a Wi-Fi frequency band of 5 GHz. This allows the first antenna 10 to transmit and receive signals of Bluetooth and Wi-Fi communication systems. In the present embodiment, the first antenna 10 is a Quarter-wavelength PIFA (Planar Inverted-F Antenna), which is the main antenna of the wireless communication device of the present embodiment.

The second antenna 20 includes a second feed terminal A2 and a second ground terminal B2. The direction of the line connecting the second feed terminal A2 and the second ground terminal B2 is parallel to the second direction D2, and the second feed terminal A2 is coupled with the circuit board 70 to receive the feed signal. The second antenna 20 receives the feed signal to provide a signal within a low frequency band and a signal within a high frequency band. In the present embodiment, the low frequency band provided by the second antenna 20 is a Wi-Fi frequency band of 2.4 GHz, while the high frequency band provided by the second antenna 20 is a Wi-Fi frequency band of 5 GHz. This allows the second antenna 20 to transmit and receive signals of the Wi-Fi communication system. In the present embodiment, the second antenna 20 is a Quarter-wavelength PIFA, which is an auxiliary antenna of the wireless communication device of the present embodiment.

The third antenna 30 includes a third feed terminal A3 and a third ground terminal B3. The direction of the line connecting the third feed terminal A3 and the third ground terminal B3 is parallel to the first direction D1. Since the first direction D1 is perpendicular to the second direction D2, the direction of the line connecting the third feed terminal A3 and the third ground terminal B3 is perpendicular to the direction of the line connecting the second feed terminal A2 and the second ground terminal B2.

The third feed terminal A3 is coupled with the circuit board 70 to receive the feed signal. The third antenna 30 receives the feed signal to provide a signal within a low frequency band. In the present embodiment, the low frequency band provided by the second antenna 20 is a Zigbee frequency band of 2.4 GHz, which allows the third antenna 30 to transmit and receive signals of the Zigbee wireless communication system. In the present embodiment, the first antenna 10 and the second antenna 20 are of the same antenna type, that is, the first antenna 10 and the second antenna 20 are both Quarter-wavelength PIFAs. The third antenna 30 is a half-wavelength loop antenna, and therefore the type of the third antenna 30 is different from the type of the first antenna 10 and the second antenna 20.

The circuit board 70 further includes a coaxial transmission line (not shown in the drawing). The coaxial transmission line includes a positive terminal and a negative terminal. The first feed terminal A1, the second feed terminal A2 and the third feed terminal A3 are electrically connected with the positive terminal of the coaxial transmission line to receive the feed signal. The first ground terminal B1, the second ground terminal B2 and the third ground terminal B3 are electrically connected with the negative terminal of the coaxial transmission line to be connected with the circuit board 70 and a ground.

As shown in FIG. 2, the distance Xd from the first antenna 10, the second antenna 20 and the third antenna 30 to the circuit board 70 is about 5.7 mm, and the first antenna 10 can be disposed at a location away from noise sources such as the battery 55 and the power adaptor board 80.

In the present embodiment, since the size of the wireless communication device 100 is small, the heat dissipation capability can be improved by using the metallic heat sink 40 and the metallic housing 90 to dissipating heat and lowering the temperature.

Figure 3:
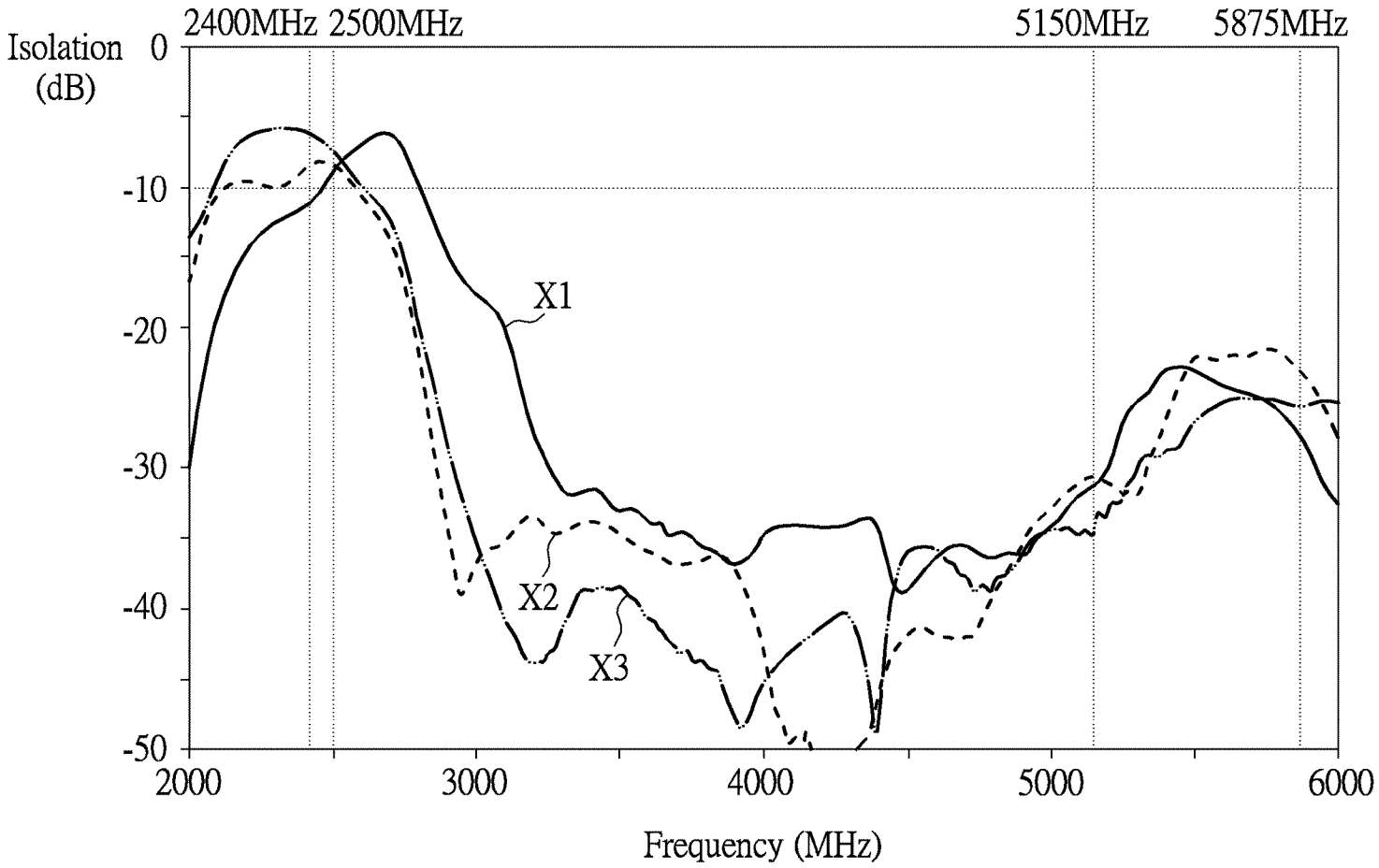
FIG. 3 is a schematic diagram showing the antenna isolation of the wireless communication device not including a metallic heat sink and ground points.
Figure 4:
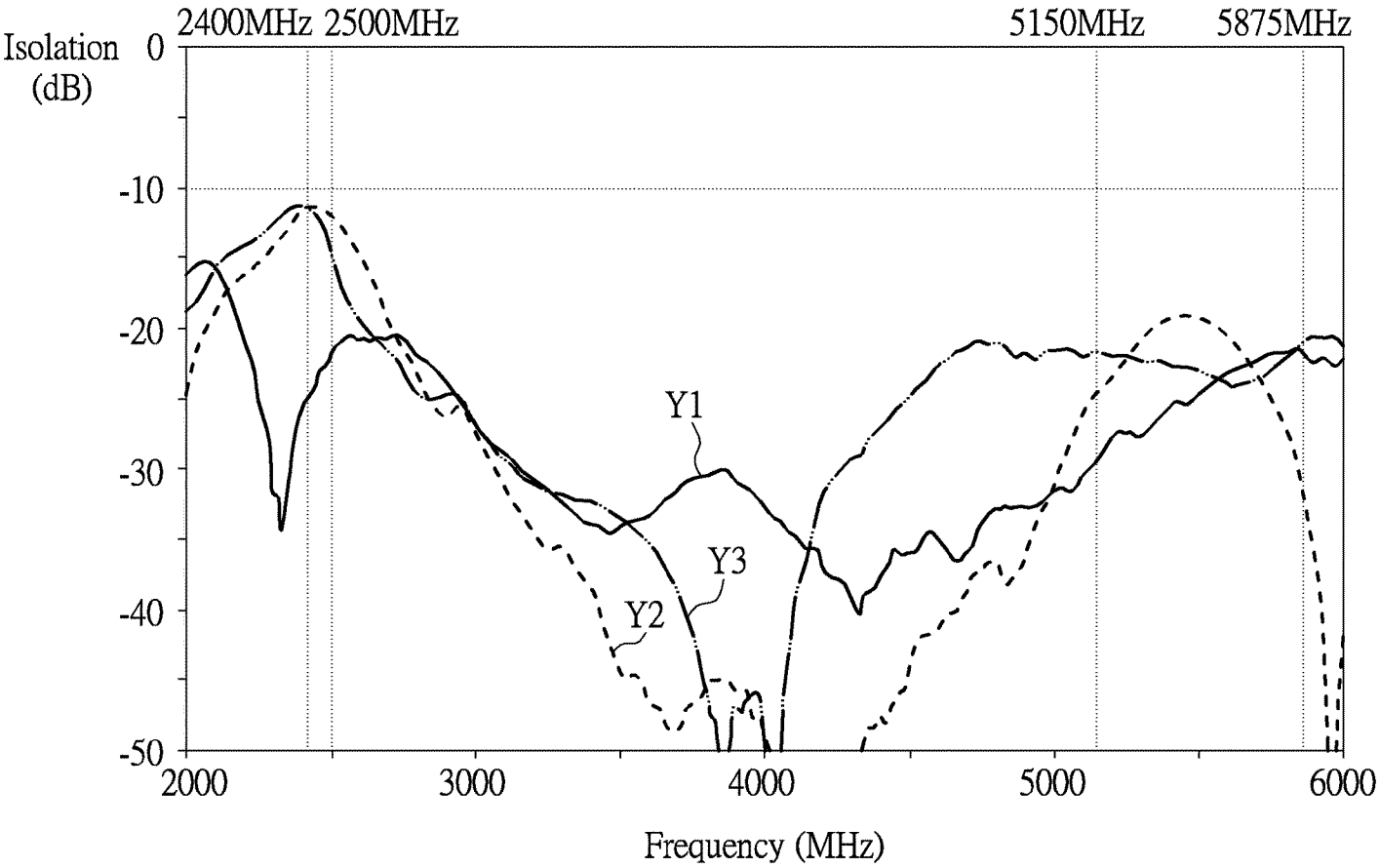
FIG. 4 is a schematic diagram showing the antenna isolation of the wireless communication device according to an embodiment of the invention.

FIG. 3 and FIG. 4 show the isolations between the antennas of the wireless communication devices both having three antennas (that is, the first antenna 10, the second antenna 20 and the third antenna 30) with and without the metallic heat sink 40 and the ground points C1 to C4. FIG. 3 is a schematic diagram showing the measured isolation of the wireless communication device including the first antenna 10, the second antenna 20 and the third antenna 30 but not including the metallic heat sink 40 and the ground points C1 to C4. FIG. 4 is a schematic diagram showing the measured isolation of the wireless communication device 100 according to the embodiment of the invention including the first antenna 10, the second antenna 20, the third antenna 30, the metallic heat sink 40 and the ground points C1 to C4. In FIG. 3 and FIG. 4, the vertical axis represents the isolation (in dB), and the horizontal axis represents the frequency (in MHz).

Please refer to FIG. 3, the curve X1 represents the isolation between the first antenna 10 and the second antenna 20 under different frequencies, the curve X2 represents the isolation between the first antenna 10 and the third antenna 30 under different frequencies, and the curve X3 represents the isolation between the second antenna 20 and the third antenna 30 under different frequencies. FIG. 3 shows that the isolations between the three antennas are all higher than −10 dB at the low frequency of 2.4 GHz, which means that the isolations between the three antennas are relatively poor.

Please refer to FIG. 4, the curve Yl represents the isolation between the first antenna 10 and the second antenna 20 in the wireless communication device 100 according to the embodiment of the invention under different frequencies, the curve Y2 represents the isolation between the first antenna 10 and the third antenna 30 in the wireless communication device 100 according to the embodiment of the invention under different frequencies, and the curve Y3 represents the isolation between the second antenna 20 and the third antenna 30 in the wireless communication device 100 according to the embodiment of the invention under different frequencies. FIG. 4 shows that by disposing the metallic heat sink 40 and the ground points C1 to C4, the isolations between the three antennas are all lower than −10 dB at the same frequency (that is, 2.4 GHz), which means that the isolations between the three antennas are good.

Figure 5:
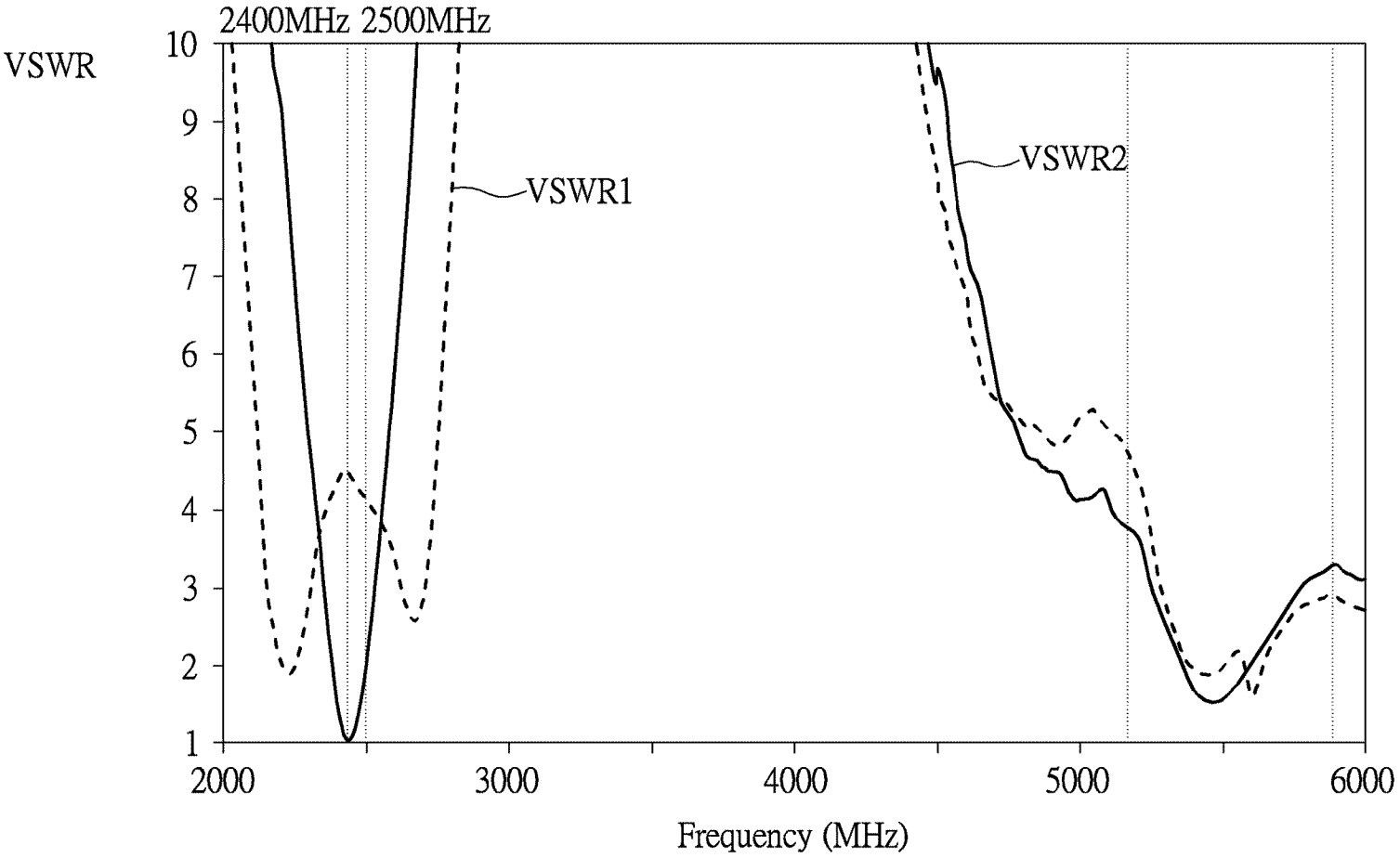
FIG. 5 is a schematic diagram showing the VSWR (voltage standing wave ratio) of the wireless communication device according to an embodiment of the invention.

FIG. 5 is a schematic diagram showing the VSWR (voltage standing wave ratio) of the wireless communication device including three antennas (that is, the first antenna 10, the second antenna 20 and the third antenna 30) with and without the metallic heat sink 40 and the ground points C1 to C4. The curve VSWR1 represents the measured VSWR of the wireless communication device including the first antenna 10, the second antenna 20 and the third antenna 30 but not including the metallic heat sink 40 and the ground points C1 to C4. The curve VSWR2 represents the measured VSWR of the wireless communication device 100 according to the embodiment of the invention including the first antenna 10, the second antenna 20, the third antenna 30, the metallic heat sink 40 and the ground points C1 to C4. In FIG. 5, the vertical axis represents the VSWR, and the horizontal axis represents the frequency (in MHz). As shown in FIG. 5, by disposing the metallic heat sink 40 and the ground points C1 to C4, the VSWR of the wireless communication device 100 according to the embodiment of the invention in the same frequency band is closer to the ideal value of 1, such that good matches between the three antennas can be achieved.

Figure 6:
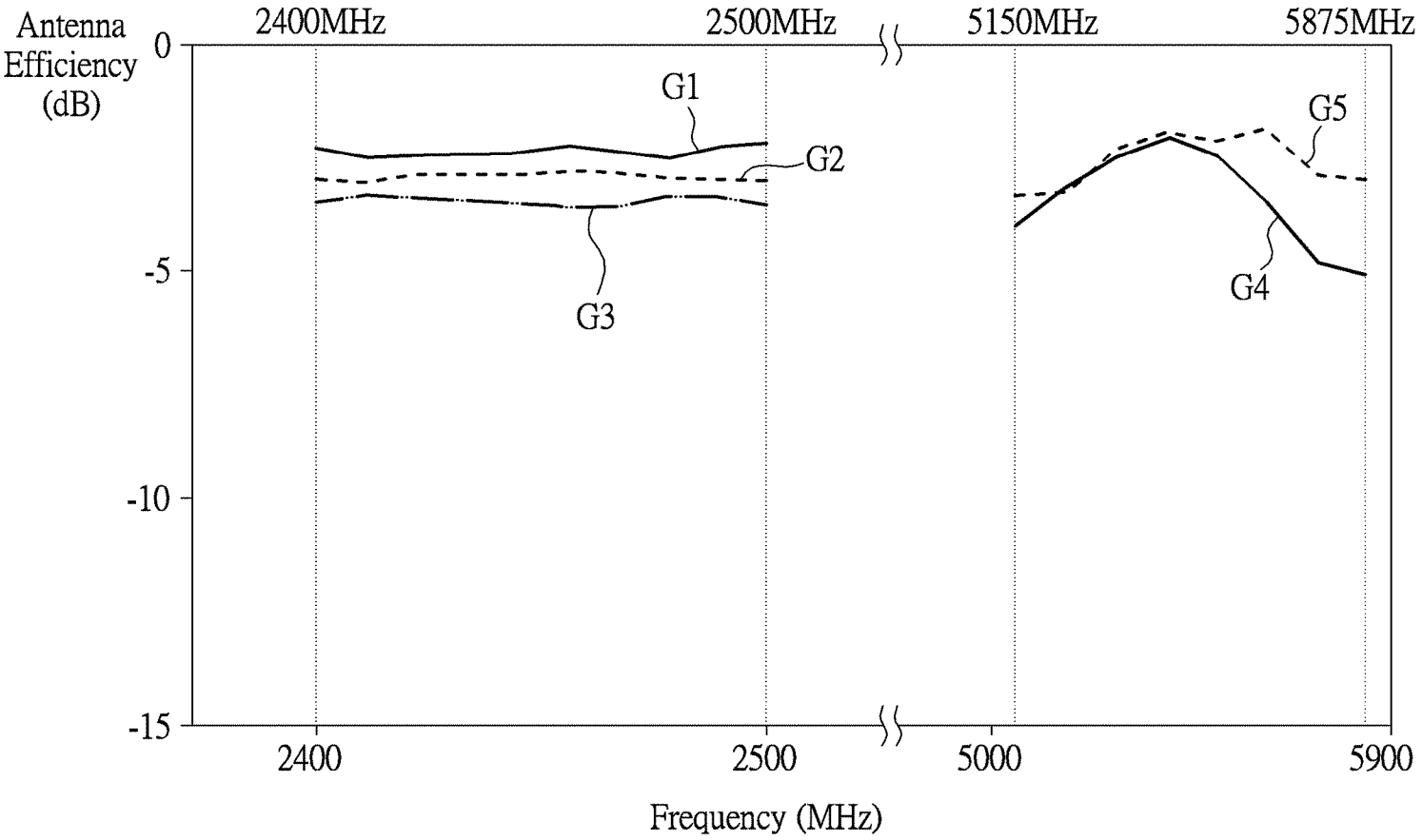
FIG. 6 is a schematic diagram showing the antenna efficiency of the wireless communication device according to an embodiment of the invention.

FIG. 6 is a schematic showing the antenna efficiency of the three antennas of the wireless communication device 100 according to the embodiment of the invention. The curve G1 represents the antenna efficiency of the first antenna 10 at the Bluetooth/Wi-Fi frequency band of 2.4 GHz. The curve G2 represents the antenna efficiency of the second antenna 20 at the Wi-Fi frequency band of 2.4 GHz. The curve G3 represents the antenna efficiency of the third antenna 30 at the Zigbee frequency band of 2.4 GHz. The curve G4 represents the antenna efficiency of the first antenna 10 at the Bluetooth/Wi-Fi frequency band of 5 GHz. The curve G5 represents the antenna efficiency of the second antenna 20 at the Wi-Fi frequency band of 5 GHz. In FIG. 6, the vertical axis represents the antenna efficiency (in dB), and the horizontal axis represents the frequency (in MHz).

To sum up, in the wireless communication device including multiple antennas, disposing the metallic heat sink between the first antenna 10 and the third antenna 30 can effectively improve the isolation between the first antenna 10 and the third antenna 30. Although the second antenna 20 and the third antenna 30 are both disposed at the second region 9012, the interference between the two antennas can be avoided and the isolation between them can be improved by using different antenna types and disposing them perpendicularly to each other. Moreover, disposing the ground points C1 to C4 can eliminate the frequency band generated by resonance between the circuit board 70 and the metallic housing 90. Therefore, the isolations between the three antennas can be improved. Furthermore, by disposing the metallic heat sink 40 and the metallic housing 90, the heat dissipating capability of the wireless communication device 100 can also be improved to dissipate heat and reduce the temperature. Therefore, the invention can improve the isolations between multiple antennas and the heat dissipating capability effectively.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wireless communication device, comprising:

a metallic housing including a chamber;

a circuit board disposed in the chamber, circuit board being for providing a feed signal and a ground;

a metallic heat sink disposed on the circuit board, the metallic heat sink being for dividing the chamber into a first region and a second region;

a first antenna disposed at the first region along a first direction, the first antenna being coupled with the circuit board;

a second antenna disposed at the second region along a second direction, the second antenna being coupled with the circuit board, wherein the second direction is perpendicular to the first direction; and a third antenna disposed at the second region along the first direction and located between the metallic heat sink and the second antenna, the third antenna being coupled with the circuit board, wherein the first antenna, the second antenna and the third antenna receive the feed signal and at least are capable of generating signals at the same frequency band.

2. The wireless communication device according to claim 1, wherein the circuit board includes a first ground point and a second ground point, the first ground point and the second ground point are located at a central region of the circuit board, and the circuit board is connected with the metallic housing via the first ground point and the second ground point.

3. The wireless communication device according to claim 2, wherein the circuit board further includes a third ground point and a fourth ground point, the third ground point and the fourth ground point are located between the first antenna and the metallic heat sink, and the circuit board is connected with the metallic housing via the third ground point and the fourth ground point.

4. The wireless communication device according to claim 1, wherein:

the first antenna includes a first feed terminal and a first ground terminal, the direction of the line connecting the first feed terminal and the first ground terminal is parallel to the first direction, and the first feed terminal is coupled with the circuit board to receive the feed signal;

the second antenna includes a second feed terminal and a second ground terminal, the direction of the line connecting the second feed terminal and the second ground terminal is parallel to the second direction, and the second feed terminal is coupled with the circuit board to receive the feed signal; and the third antenna includes a third feed terminal and a third ground terminal, the direction of the line connecting the third feed terminal and the third ground terminal is parallel to the first direction, and the third feed terminal is coupled with the circuit board to receive the feed signal.

5. The wireless communication device according to claim 4, wherein the circuit board further includes a coaxial transmission line, the coaxial transmission line includes a positive terminal and a negative terminal, the first feed terminal, the second feed terminal and the third feed terminal are electrically connected with the positive terminal of the coaxial transmission to receive the feed signal, and the first ground terminal, the second ground terminal and the third ground terminal are connected with the negative terminal of the coaxial transmission line to ground.

6. The wireless communication device according to claim 1, wherein the first antenna is a quarter-wavelength planar inverted-F antenna, the second antenna is a quarter-wavelength planar inverted-F antenna, and the third antenna is a half-wavelength loop antenna.

7. The wireless communication device according to claim 1, wherein:

the first antenna receives the feed signal to provide a signal at a low frequency band and a signal at a high frequency band;

the second antenna receives the feed signal to provide a signal at the low frequency band and a signal at the high frequency band; and the third antenna receives the feed signal to provide a signal at the low frequency band.

8. The wireless communication device according to claim 7, wherein:

the low frequency band provided by the first antenna is a Bluetooth frequency band at 2.4 GHz and a Wi-Fi frequency band at 2.4 GHz, and the high frequency band provided by the first antenna is a Wi-Fi frequency band at 5 GHz;

the low frequency band provided by the second antenna is a Wi-Fi frequency band at 2.4 GHz, and the high frequency band provided by the second antenna is a Wi-Fi frequency band at 5 GHz; and the low frequency band provided by the third antenna is a Zigbee frequency band at 2.4 GHz.

* * * * *